US007114452B1

(12) United States Patent
Owen

(10) Patent No.: US 7,114,452 B1
(45) Date of Patent: Oct. 3, 2006

(54) SAILING ACCESSORY

(76) Inventor: Jim Owen, 23504 Deerfield Park Dr. #4, Hill City, SD (US) 57745

( * ) Notice: Subject to any disclaimer, the term of this patent is extended or adjusted under 35 U.S.C. 154(b) by 353 days.

(21) Appl. No.: 10/684,841

(22) Filed: Oct. 14, 2003

(51) Int. Cl.
*A47B 23/00* (2006.01)

(52) U.S. Cl. ..... 108/44; 108/25

(58) Field of Classification Search ..... 108/43, 108/44, 25, 26, 152, 41, 92, 93
See application file for complete search history.

(56) References Cited

U.S. PATENT DOCUMENTS

| | | | | | |
|---|---|---|---|---|---|
| 2,723,037 | A | * | 11/1955 | Matesic | 108/44 |
| 3,893,569 | A | * | 7/1975 | Hoch | 108/44 |
| 4,086,859 | A | | 5/1978 | Dondero | |
| 4,122,780 | A | * | 10/1978 | Brickman | 108/25 |
| 4,940,003 | A | * | 7/1990 | Mayhew et al. | 108/44 |
| 5,048,444 | A | | 9/1991 | Moore | |
| 5,092,263 | A | | 3/1992 | Hutchinson et al. | |
| 5,207,162 | A | | 5/1993 | Mismas | |
| 5,222,690 | A | | 6/1993 | Jeffords | |
| 5,492,068 | A | | 2/1996 | Mckee | |
| 5,584,531 | A | * | 12/1996 | Bowman | 108/25 |
| 5,749,305 | A | * | 5/1998 | Jacovelli | 108/44 |
| 5,845,585 | A | * | 12/1998 | Meeus et al. | 108/44 |
| D420,322 | S | | 2/2000 | Hampshire | |
| 6,036,158 | A | * | 3/2000 | Raasch | 108/44 |
| 6,125,771 | A | | 10/2000 | Platt et al. | |
| 6,412,425 | B1 | * | 7/2002 | Chen | 108/44 |
| 6,748,874 | B1 | * | 6/2004 | Gawronski | 108/42 |
| 2001/0038536 | A1 | | 11/2001 | Wiggerman et al. | |
| 2002/0166493 | A1 | | 11/2002 | Sorensen | |

* cited by examiner

*Primary Examiner*—Jose V. Chen
(74) *Attorney, Agent, or Firm*—Jeffrey A. Proehl; Woods Fuller Shultz & Smith PC

(57) ABSTRACT

A sailing accessory for selectively receiving and holding personal accessories of a user and providing convenient access to the accessories for a helmsman. The sailing accessory includes a top member and a bottom member. The top member includes a slot which extends therethrough. The slot is designed for receiving a top portion of a pedestal guard. The top member defines a work surface. The bottom member is operationally coupled to the top member. The bottom member includes a front edge designed for abutting a back side of the pedestal guard.

20 Claims, 6 Drawing Sheets

SAILING ACCESSORY

BACKGROUND OF THE INVENTION

1. Field of the Invention

The present invention relates to cockpit tables and organizers and more particularly pertains to a new sailing accessory for providing safe, convenient, and unobtrusive storage and mounting locations for various equipments to be accessed by the helmsman while underway.

2. Description of the Prior Art

The use of cockpit tables and organizers is known in the prior art. U.S. Pat. No. 5,207,162 describes an expandable table, which may be clamped to a pedestal guard opposite of the wheel. This arrangement severely inhibits the access to the table by the helmsman. Another type of cockpit table is U.S. Pat. No. 4,086,859 having a offset support for pivoting the table out of the way to allow passage through the cockpit. While this table is particularly useful when not actively underway, it inhibits normal crew activity while sailing.

While these devices fulfill their respective, particular objectives and requirements, the need remains for a system which allows convenient safe access to various equipments by the helmsman without distracting the helmsman from his primary duties.

It is a further object of the present invention to provide a work surface which will hold personal accessories and beverages for the helmsman while the craft pitches and rolls.

SUMMARY OF THE INVENTION

Sailing provides a means for man to commune with nature in a solitary manner. Sailing, especially in recreational craft, has inherent dangers second only to flying. For the solitary sailor, or the helmsman of a small recreational craft, the workload from navigation, steering, monitoring communications and the weather, can be overwhelming; and in adverse conditions, momentary distractions can lead to disaster. The present invention actively assists the helmsman by providing organizational assistance, allowing the helmsman to have items of operational safety, navigation and convenience close at hand, without interfering with the operation of the craft.

Many new production sailboats are factory equipped for pedestal (wheel) steering rather than a traditional tiller. Additionally, many more craft have been converted from tiller to pedestal steering. Pedestal steering can make a boat easier to control and therefore make sailing more accessible to persons of all ages. Further, in many craft, replacement of the tiller with a pedestal steering unit can increase the usable space in the cockpit. Typical pedestal steering units include a pedestal, which is mounted to the deck of the boat, and a wheel, which is coupled to a side of the pedestal near the top. The pedestal may include a mounting means for receiving a magnetic compass. Further, the pedestal unit may include a pedestal guard, which serves to protect the compass, and provides a hand-hold for crew members. This protection is particularly desirable on boats with a mainsheet traveler just forward of the pedestal. The pedestal guard may have a straight, angled, or offset configuration based upon the needs of the particular craft.

The pedestal may also serve as a mounting point for engine control assemblies utilizing either single lever or multiple lever controls. An illustrative example of a multiple lever control assembly may include a clutch lever (forward/reverse) and a throttle lever (fast/slow).

Typical examples of this type of pedestal steering system include those manufactured by Edson International, 146 Duchaine Blvd, New Bedford, Mass. 02745-1292 (edson-marine.com).

The present invention provides multiple advantages over the patents previously noted including, but certainly not limited to accessibility by the helmsman, ease of mounting, and user configurablity.

To this end, the present invention generally comprises a top member and a bottom member. The top member includes a slot which extends therethrough. The slot is designed for receiving a top portion of a pedestal guard. The top member defines a work surface. The bottom member is operationally coupled to the top member. The bottom member includes a front edge designed for abutting a back side of the pedestal guard.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
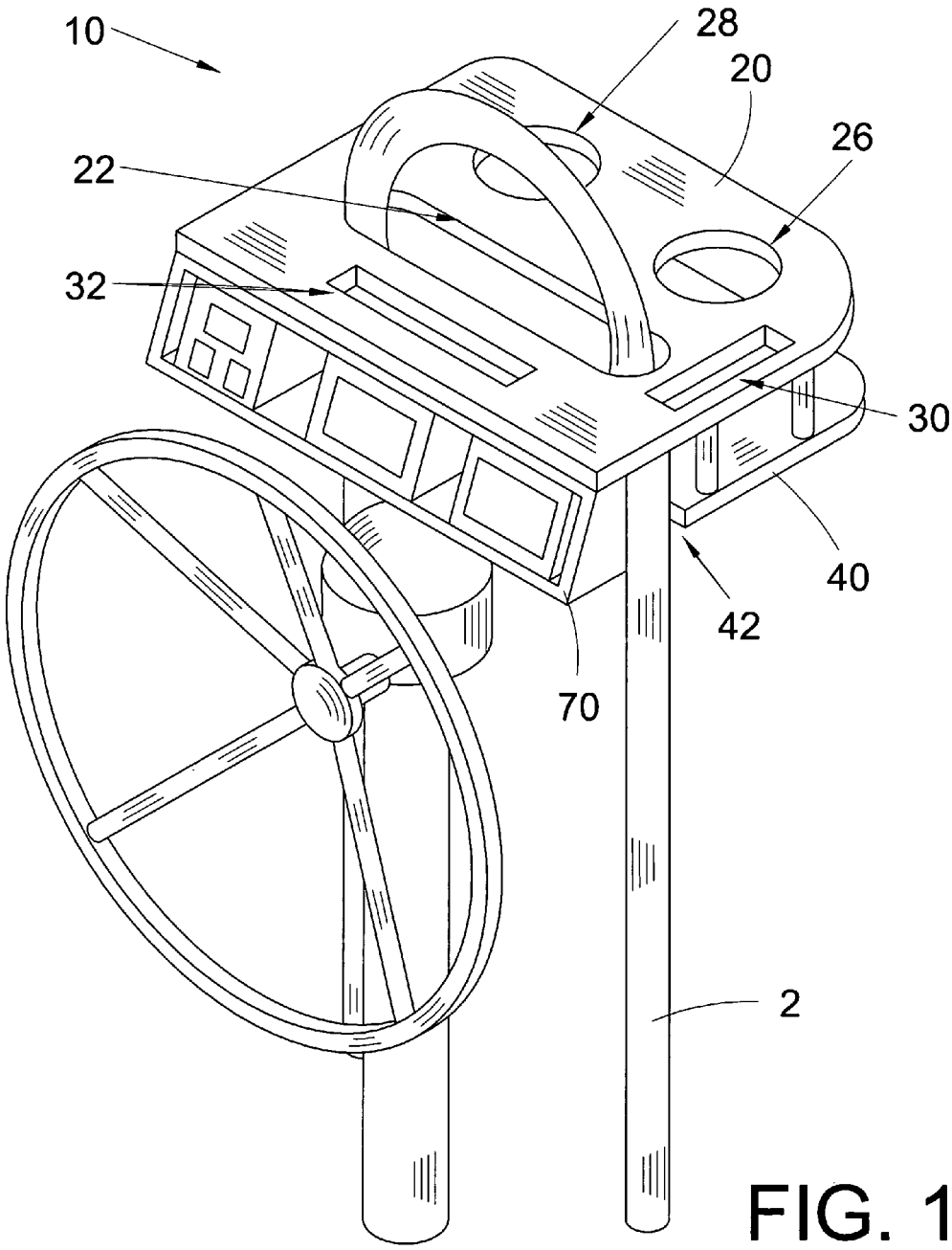
FIG. 1 is a schematic perspective view of a new sailing accessory according to the present invention.
Figure 2:
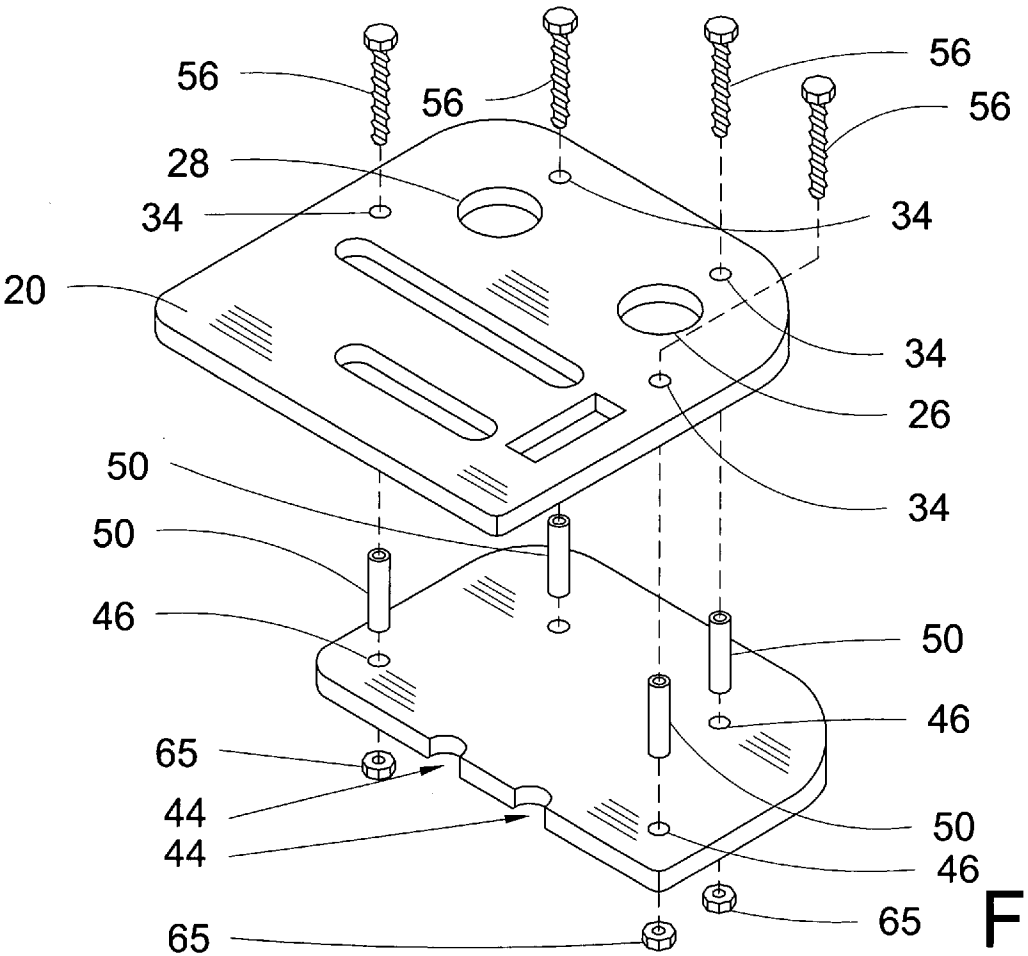
FIG. 2 is a schematic perspective exploded view of the present invention.
Figure 3:
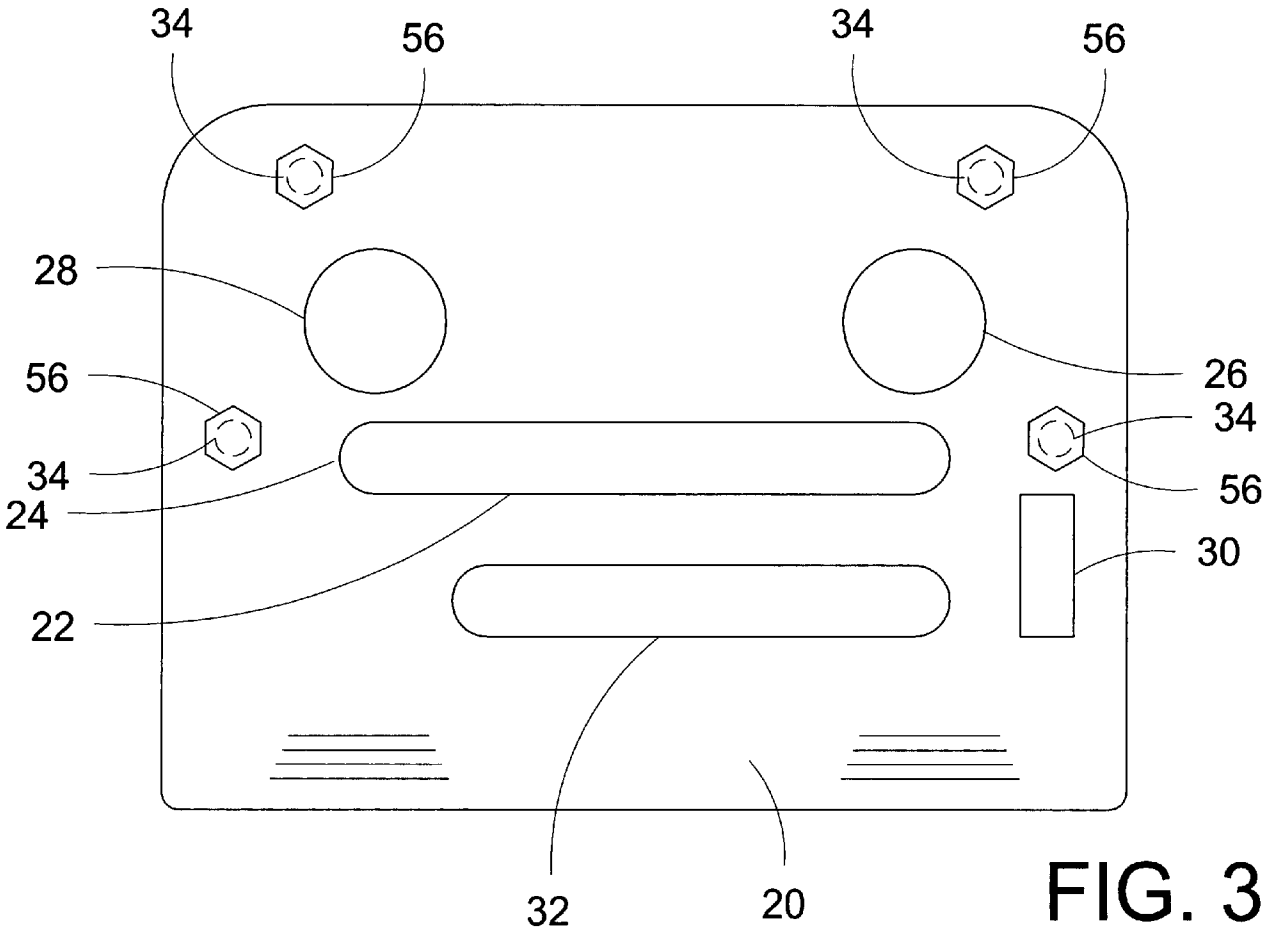
FIG. 3 is a schematic top view of the top member of the present invention.
Figure 4:
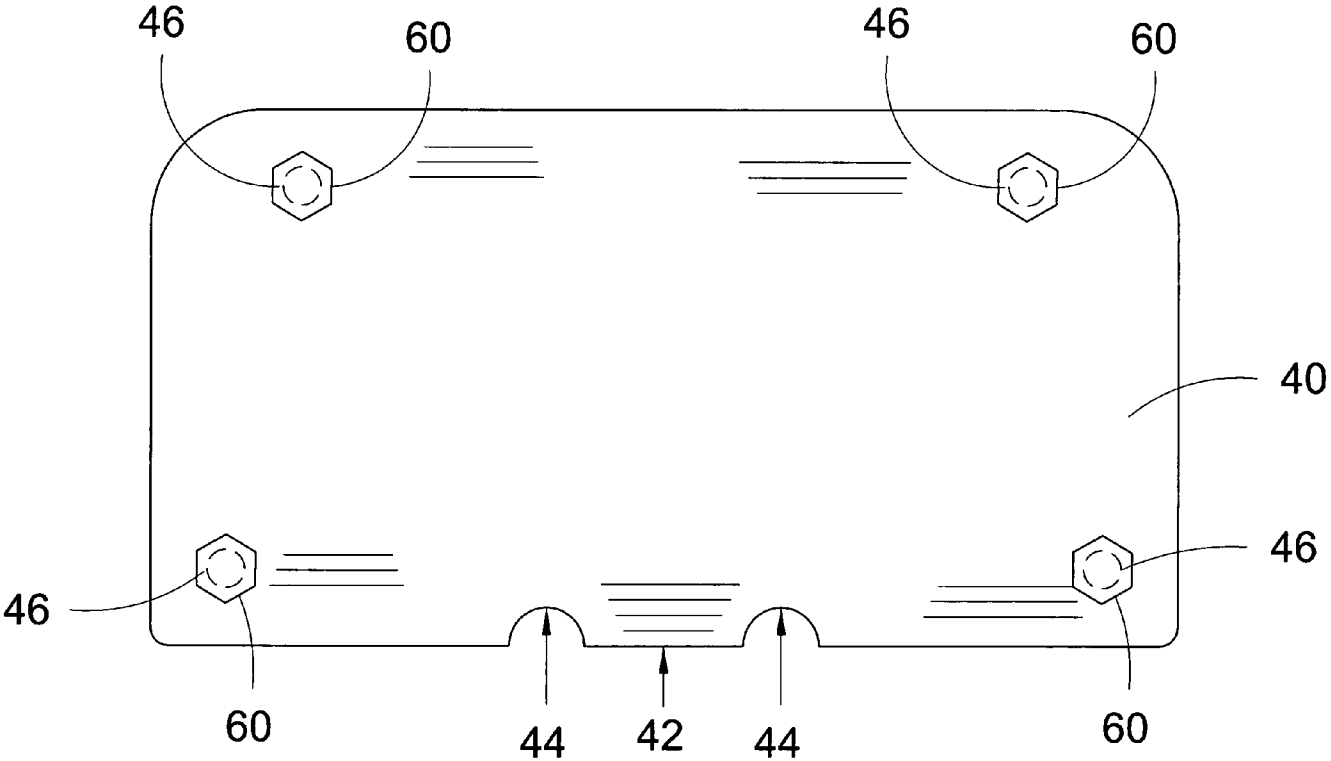
FIG. 4 is a schematic top view of the bottom member of the present invention.
Figure 5:
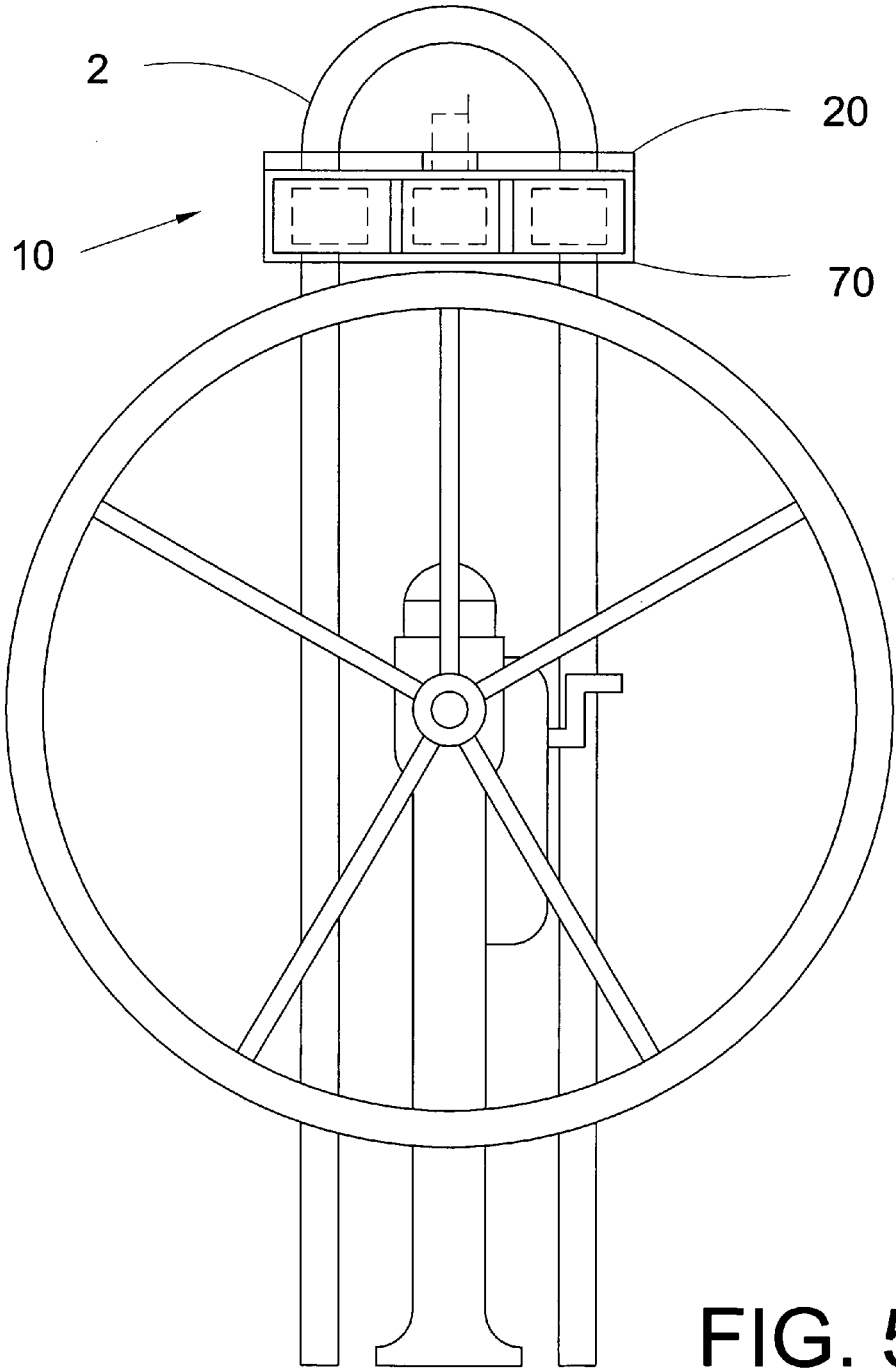
FIG. 5 is a schematic front view of the present invention.
Figure 6:
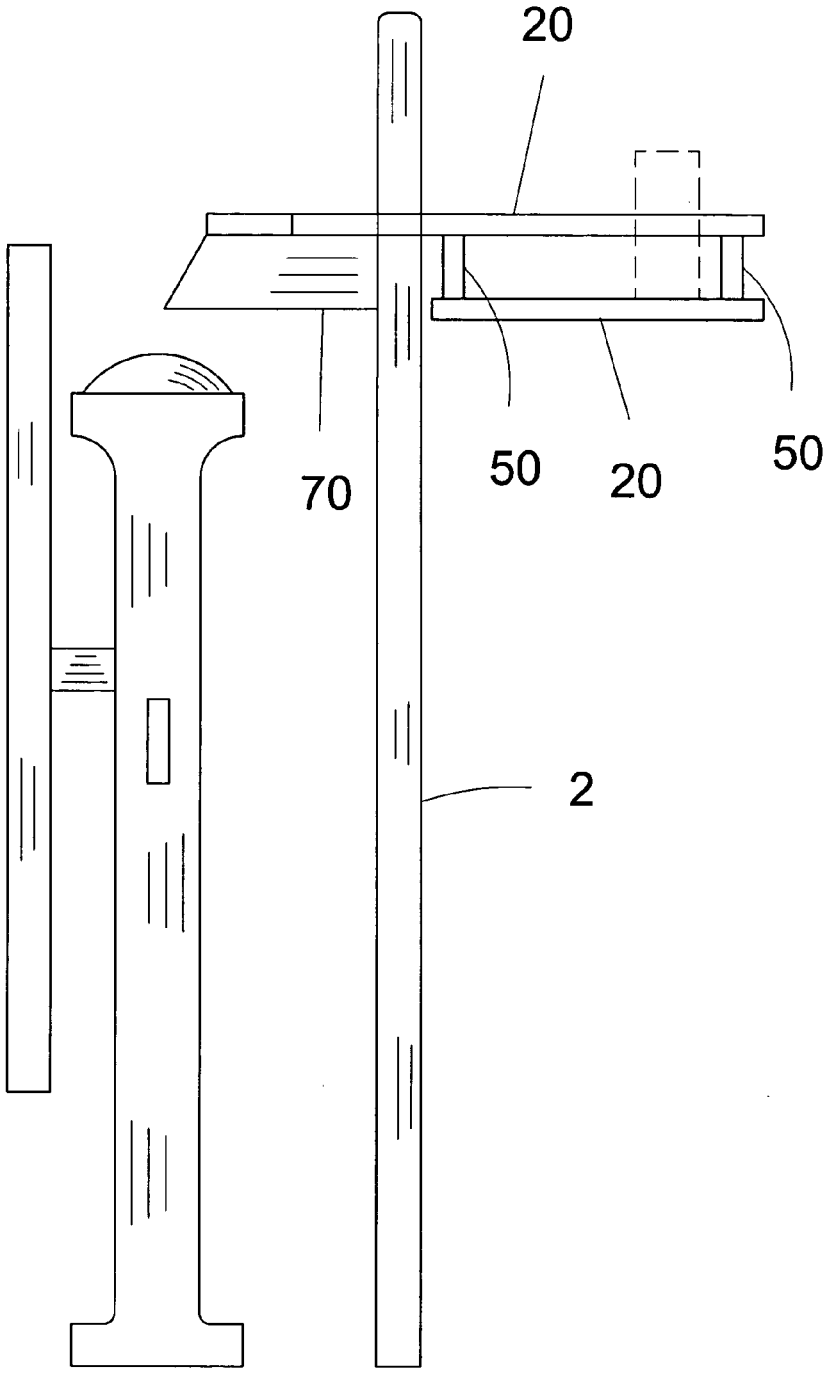
FIG. 6 is a schematic side view of the present invention.

With reference now to the drawings, and in particular to FIGS. 1 through 6 thereof, a new sailing accessory embodying the principles and concepts of the present invention and generally designated by the reference numeral 10 will be described.

As best illustrated in FIGS. 1 through 6, the sailing accessory 10 generally a top member 20 and a bottom member 40. The top member 20 includes a slot 22, which extends therethrough. The slot 22 is designed for receiving a top portion of a pedestal guard 2. The top member 20 defines a work surface. The bottom member 40 is operationally coupled to the top member 20. The bottom member 40 includes a front edge 42 designed for abutting a back side of the pedestal guard 2.

In an embodiment the slot 22 includes arcuate ends 24 for increasing a surface area of the top member 20 in contact with the pedestal guard 2.

Preferably a pair of notches 44 is positioned in the front edge 42 of the bottom member 40. Each one of the notches 44 is for receiving a back side of a rail of the pedestal guard 2. The notches 44 increase a surface area of the bottom member 40 contacting the pedestal guard 2.

In a preferred embodiment, a pair of apertures 26,28 extends through the top member 20. Each one of the apertures 26,28 is designed for receiving a beverage container. Each one of the apertures 26,28 is positioned through an associated side of the top member 20 behind the pedestal guard 2 when the system 10 is installed on the pedestal guard 2.

In a further embodiment, a bore 30 also extends through the top member 20. The bore 30 is preferably positioned adjacent to the slot 22, for selectively receiving a piece of accessory equipment for ready access by the user.

In yet a further embodiment, a secondary slot 32 extends through the top member 20. The secondary slot 32 is preferably positioned centrally adjacent to a front edge of the top member 20. The secondary slot 32 is positioned in front of the pedestal guard 2 when the system 10 is installed on the pedestal guard 2.

In a preferred embodiment, four spacer members 50 are used to operationally couple the top member 20 to the bottom member 40. The first spacer member is positioned adjacent a first front corner of the top member 20. The second spacer member is positioned adjacent a second front corner of the top member 20. The third spacer member is positioned adjacent a first rear corner of the top member 20. The fourth spacer member is positioned adjacent a second rear corner of the top member 20. Further four spacer bores 34 extend through the top member 20. Each one of the four spacer bores 34 is aligned with an associated one of the four spacer members 50. Four securing members 56 are used to couple the top member 20 to the spacer members 50. Each one of the four securing members 56 is positionable within an associated one of the four spacer bores 34. Similarly, four bottom spacer bores 46 extend through the bottom member 40. Each one of the four bottom spacer bores 46 is aligned with an associated one of the four spacer members 50. Finally, four bottom securing members 60 are used to couple the bottom member 40 to the four spacer members 50. Each one of the four bottom securing members 60 is positionable through an associated one of the four bottom spacer bores 46.

In still a further embodiment, each one of the four securing members 56 is uniquely associated with one of the four spacer bores 34, one of the four spacer members 50, and one of the four bottom spacer bores 46. The four spacer members 50 each are substantially hollow. A tensioning member 65 may be coupled to an end of each one of the securing members 56 to facilitate selectively locking the securing member 56 in a static position relative to the top member 20 and the bottom member 40.

In yet a further embodiment the top member 20 includes an overall width of approximately 18 inches and an overall length of approximately 14 inches.

In even still a further embodiment each one of the pair of apertures 26,28 includes a diameter of approximately 4 inches.

The system 10 may include a communications and navigation equipment console 70 operationally coupled to the top member 20. The communications and navigation equipment console 70 is for receiving communication, navigation, and identification equipment. The communication and navigation equipment console 70 is adjacent a front edge of the top member 20. The system may also operate with a communication and navigation equipment console provided by the user independent of the present system.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pedestal steering table and organizer system for use in conjunction with pedestal steering systems, comprising:

a top member having a slot extending therethrough for receiving a top portion of a pedestal guard, said top member defining a work surface;

a bottom member being operationally coupled to said top member, said bottom member having an edge positioned below said slot in said top member so as to permit said edge to abut a back side of the pedestal guard when the top portion of the pedestal guard is received in said slot of said top member;

at least one spacer member coupled to said top member and to said bottom member to position said top and bottom members in a spaced and substantially parallel relationship with respect to each other with at least a portion of said top member being positioned above said bottom member.

2. A pedestal steering table and organizer system for use in conjunction with pedestal steering systems, comprising:

a top member having a slot extending therethrough for receiving a top portion of a pedestal guard, said top member defining a work surface;

a bottom member being operationally coupled to said top member, said bottom member having a front edge positioned below said slot in said top member so as to permit said front edge to abut a back side of the pedestal guard when the top portion of the pedestal guard is received in said slot of said top member;

wherein said front edge having a pair of notches therein, each one of said notches being for receiving a back side of a rail of the pedestal guard, said notches increasing surface area of said bottom members contacting said pedestal guard.

3. The pedestal steering table and organizer system of claim 1, wherein said top member includes at least one aperture extending therethrough, said aperture being adapted for receiving a beverage container.

4. The pedestal steering table and organizer system of claim 1, wherein said top member includes a pair of apertures extending therethrough, each one of said apertures being adapted for receiving a beverage container, each one of said apertures being positioned through an associated side of said top member behind said pedestal guard when said system is installed on said pedestal guard.

5. The pedestal steering table and organizer system of claim 1, wherein said at least one spaced member comprises a plurality of spacer members, each one of said spacer members being operationally couplable to said top member and said bottom member, said spacer members maintaining a spaced substantially parallel relationship between said top member and said bottom member.

6. The pedestal steering table and organizer system of claim 1, wherein said at least one spacer member comprises:

a first spacer member operationally couplable between said top member and said bottom member, said first spacer member being positioned adjacent a first front corner of said top member;

a second spacer member operationally couplable between said top member and said bottom member, said second spacer member being positioned adjacent a second front corner of said top member;

a third spacer member operationally couplable between said top member and said bottom member, said third spacer member being positioned adjacent a first rear corner of said top member;

a fourth spacer member operationally couplable between said top member and said bottom member, said fourth spacer member being positioned adjacent a second rear corner of said top member; and a fifth spacer member operationally couplable between said top member and said bottom member, said fifth spacer member being positioned along a central portion of a rear edge of said top member.

7. The pedestal steering table and organizer system of claim 1, wherein said at least one spacer member comprises:

a first spacer member operationally couplable between said top member and said bottom member, said first spacer member being positioned adjacent a first front corner of said top member;

a second spacer member operationally couplable between said top member and said bottom member, said second spacer member being positioned adjacent a second front corner of said top member;

a third spacer member operationally couplable between said top member and said bottom member, said third spacer member being positioned adjacent a first rear corner of said top member; and a fourth spacer member operationally couplable between said top member and said bottom member, said fourth spacer member being positioned adjacent a second rear corner of said top member.

8. The pedestal steering table and organizer system of claim 7, further comprising:

a first spacer bore extending through said top member aligned with said first spacer member;

a first securing member positionable within said first spacer bore for securing said first spacer member to said top member;

a second spacer bore extending through said top member aligned with said second spacer member;

a second securing member positionable within said second spacer bore for securing said second spacer member to said top member;

a third spacer bore extending through said top member aligned with said third spacer member;

a third securing member positionable within said third spacer bore for securing said third spacer member to said top member;

a fourth spacer bore extending through said top member aligned with said fourth spacer member; and a fourth securing member positionable within said fourth spacer bore for securing said fourth spacer member to said top member.

9. The pedestal steering table and organizer system of claim 7, further comprising:

a first bottom spacer bore extending through said bottom member aligned with said first spacer member;

a first bottom securing member positionable within said first bottom spacer bore for securing said first spacer member to said bottom member;

a second bottom spacer bore extending through said bottom member aligned with said second spacer member;

a second bottom securing member positionable within said second bottom spacer bore for securing said second spacer member to said bottom member;

a third bottom spacer bore extending through said bottom member aligned with said third spacer member;

a third bottom securing member positionable within said third bottom spacer bore for securing said third spacer member to said bottom member;

a fourth bottom spacer bore extending through said bottom member aligned with said fourth spacer member; and a fourth bottom securing member positionable within said fourth bottom spacer bore for securing said fourth spacer member to said bottom member.

10. A pedestal steering table and organizer system comprising:

a top member having a slot extending therethrough for receiving a top portion of a pedestal guard, said top member defining a work surface;

a bottom member being operationally coupled to said top member, said bottom member having a front edge positioned below said slot in said top member so as to permit said front edge to abut a back side of the pedestal guard when the top portion of the pedestal guard is received in said slot of said top member;

wherein said top member includes at least one bore extending therethrough, said bore being positioned adjacent to said slot for selectively receiving a piece of accessory equipment for ready access by the user.

11. The pedestal steering table and organizer system of claim 1, wherein said slot includes arcuate ends for increasing a surface area of said top member in contact with said pedestal guard.

12. The pedestal steering table and organizer system of claim 1, wherein said top member includes a secondary slot extending therethrough, said secondary slot being positioned centrally adjacent to a front edge of said top member, said secondary slot being positioned in front of said pedestal guard when said system is installed on the pedestal guard.

13. A pedestal steering table and organizer system for mounting on a pedestal steering system, comprising:

a top member having a slot extending therethrough for receiving a top portion of a pedestal guard, said top member defining a work surface;

wherein said slot includes arcuate ends for increasing a surface area of said top member in contact with said pedestal guard a bottom member being operationally coupled to said top member, said bottom member having a front edge positioned below said slot in said top member so as to permit said front edge to abut a back side of the pedestal guard when the top portion of the pedestal guard is received in said slot of said top member;

a pair of notches positioned in said front edge of said bottom member, each one of said notches being for receiving a back side of a rail of the pedestal guard and increasing surface area of said bottom members contacting said pedestal guard;

a pair of apertures extending therethrough, each one of said apertures being adapted for receiving a beverage container, each one of said apertures being positioned through an associated side of said top member behind said pedestal guard when said system is installed on said pedestal guard;

at least one bore extending therethrough, said bore being positioned adjacent to said slot for selectively receiving a piece of accessory equipment for ready access by the user;

a secondary slot extending therethrough, said secondary slot being positioned centrally adjacent to a front edge of said top member, said secondary slot being positioned in front of said pedestal guard when said system is installed on the pedestal guard;

a first spacer member operationally couplable between said top member and said bottom member, said first spacer member being positioned adjacent a first front corner of said top member;

a second spacer member operationally couplable between said top member and said bottom member, said second spacer member being positioned adjacent a second front corner of said top member;

a third spacer member operationally couplable between said top member and said bottom member, said third spacer member being positioned adjacent a first rear corner of said top member;

a fourth spacer member operationally couplable between said top member and said bottom member, said fourth spacer member being positioned adjacent a second rear corner of said top member;

a first spacer bore extending through said top member aligned with said first spacer member;

a first securing member positionable within said first spacer bore for securing said first spacer member to said top member;

a second spacer bore extending through said top member aligned with said second spacer member;

a second securing member positionable within said second spacer bore for securing said second spacer member to said top member;

a third spacer bore extending through said top member aligned with said third spacer member;

a third securing member positionable within said third spacer bore for securing said third spacer member to said top member;

a fourth spacer bore extending through said top member aligned with said fourth spacer member;

a fourth securing member positionable within said fourth spacer bore for securing said fourth spacer member to said top member;

a first bottom spacer bore extending through said bottom member aligned with said first spacer member;

a first bottom securing member positionable within said first bottom spacer bore for securing said first spacer member to said bottom member;

a second bottom spacer bore extending through said bottom member aligned with said second spacer member;

a second bottom securing member positionable within said second bottom spacer bore for securing said second spacer member to said bottom member;

a third bottom spacer bore extending through said bottom member aligned with said third spacer member;

a third bottom securing member positionable within said third bottom spacer bore for securing said third spacer member to said bottom member;

a fourth bottom spacer bore extending through said bottom member aligned with said fourth spacer member;

a fourth bottom securing member positionable within said fourth bottom spacer bore for securing said fourth spacer member to said bottom member.

14. The pedestal steering table and organizer system of claim 13, wherein said top member having an overall width of approximately 18 inches and an overall length of approximately 14 inches.

15. The pedestal steering table and organizer system of claim 13, wherein each one of said pair of apertures having a diameter of approximately 4 inches.

16. The pedestal steering table and organizer system of claim 13, further comprising a communications and navigation equipment console operationally coupled to said top member, said communications and navigation equipment console being for receiving communication, navigation, and identification equipment, said communication and navigation equipment console being adjacent a front edge of said top member.

17. The pedestal steering table and organizer system of claim 1, wherein said front edge having a pair of notches therein, each one of said notches being for receiving a back side of a rail of the pedestal guard, said notches increasing surface area of said bottom members contacting said pedestal guard.

18. The pedestal steering table and organizer system of claim 2, further comprising a plurality of spacer members, each one of said spacer members being operationally couplable to said top member and said bottom member, said spacer members maintaining a spaced substantially parallel relationship between said top member and said bottom member.

19. The pedestal steering table and organizer system of claim 1 wherein said top member includes at least one aperture extending therethrough for selectively receiving an accessory for ready access by the user.

20. The pedestal steering table and organizer system of claim 19 wherein a portion of said top member including said at least one aperture overhangs a portion of said bottom member such that an accessory positioned in said at least one aperture is capable of resting on an upper surface of said bottom member.

* * * * *